US011065777B2

(12) United States Patent
Homsky

(10) Patent No.: US 11,065,777 B2
(45) Date of Patent: Jul. 20, 2021

(54) SLICING MACHINE

(71) Applicant: Alexander Homsky, Ganei Tikva (IL)

(72) Inventor: Alexander Homsky, Ganei Tikva (IL)

( * ) Notice: Subject to any disclaimer, the term of this patent is extended or adjusted under 35 U.S.C. 154(b) by 0 days.

(21) Appl. No.: 16/655,833

(22) Filed: Oct. 17, 2019

(65) Prior Publication Data

US 2020/0122350 A1 Apr. 23, 2020

Related U.S. Application Data

(60) Provisional application No. 62/746,676, filed on Oct. 17, 2018.

(51) Int. Cl.
*B26D 7/32* (2006.01)
*B65B 25/08* (2006.01)

(52) U.S. Cl.
CPC ..... *B26D 7/325* (2013.01); *B65B 25/08* (2013.01)

(58) Field of Classification Search
CPC ..... B26D 7/325; B65B 25/08; B65H 3/50
See application file for complete search history.

(56) References Cited

U.S. PATENT DOCUMENTS 3,019,578 A 2/1962 Cohen
3,472,183 A * 10/1969 Goodman ..... A47B 9/00 108/147
3,768,805 A * 10/1973 Kuksa ..... G03G 15/6502 271/126
3,817,346 A * 6/1974 Wehmeyer ..... B66F 11/042 182/14
4,041,676 A * 8/1977 Smithers ..... B65B 25/08 53/517
5,788,348 A * 8/1998 Ramachandran ..... G07F 19/20 292/216
5,918,444 A 7/1999 Kuchler
5,944,430 A * 8/1999 Myung ..... B41J 13/103 400/624
6,361,038 B1 * 3/2002 Tada ..... B65H 1/08 271/111
6,752,056 B1 6/2004 Weber
8,448,939 B2 * 5/2013 Gerlier ..... G07D 11/13 271/147

(Continued)

FOREIGN PATENT DOCUMENTS

EP 0736361 A2 10/1996

*Primary Examiner* — Gregory W Adams
(74) *Attorney, Agent, or Firm* — Browdy and Neimark, P.L.L.C.

(57) ABSTRACT

An add-on device for a slicing machine for inserting a separation sheet in between food slices comprises a container containing (a) a sheet tray, (b) a pack of separation sheets positioned on the sheet tray, the pack of separation sheets comprises at least two types of separation sheets, each having a cut-out portion at a different location to allow contacting a second in-line sheet through a top sheet, the separation sheets are organized in said container in an alternating manner, (c) a mechanic/electro-mechanic mechanism for pushing the sheet tray upwards, (d) a three-position lever, the three-position lever comprises a left wing, a right wing and a lever actuator, the lever actuator rotates clockwise and counterclockwise across its longitudinal axis in an alternating manner, and (e) an electronic system to monitor, control, and operate the operation of the add-on device.

13 Claims, 12 Drawing Sheets

(56) References Cited

U.S. PATENT DOCUMENTS

| | | | | |
|---|---|---|---|---|
| 2013/0342164 | A1* | 12/2013 | Choi | B60L 53/14<br>320/109 |
| 2014/0246826 | A1* | 9/2014 | Kataoka | B65H 1/266<br>271/169 |
| 2016/0221773 | A1* | 8/2016 | Corallo | B65G 47/31 |

* cited by examiner

DETAIL A
SCALE 2 : 1

SLICING MACHINE

FIELD OF THE INVENTION

The present invention relates to Food cutting machines. More specifically, the present invention relates to machines for cutting and packaging food products.

BACKGROUND

A meat slicer, also called a slicing machine, deli slicer or simply a slicer, is a tool used in butcher shops and delicatessens to slice meats, sausages, cheeses and other deli products. Older models of meat slicer may be operated by crank, while newer ones generally use an electric motor. While the slicer is traditionally a commercial apparatus, domestic use versions are also marketed.

Industrial slicers such as the ones described in U.S. Pat. Nos. 3,019,578, 5,918,444, 6,752,056, and EP Patent Application No. 0736361 refer to heavy-duty slicers, mainly found in food plants, are usually high capacity machines which deal with higher food volumes. The slicing capability of these machines is only one of a large set of features, such as packaging and stamping.

The above-mentioned prior-art references describe industrial oriented slicing machines where both the challenges and the implementations are completely different from deli slicer machines.

An aim of the present invention is to provide a deli slicer having slicing and packaging capabilities.

SUMMARY OF THE INVENTION

The present invention discloses an add-on device for a slicing machine for inserting a separation sheet in between food slices comprises:

(a) a container containing a sheet tray, (b) a pack of separation sheets positioned on said sheet tray, and (c) a mechanic/electro-mechanic mechanism for pushing said sheet tray upwards for loading and for preparing the pack of separation sheets for insertion in between said food slices, (d) According to some embodiments the add on further comprises a three-position lever, said three-position lever comprises a left wing, a right wing and a lever actuator, said lever actuator rotates clockwise and counterclockwise across its longitudinal axis in an alternating manner, and an electronic system to monitor, control, and operate the operation of said add-on device;

wherein said pack of separation sheets comprises at least two types of separation sheets, a separation sheet of a first type and a separation sheet of a second type, each having a cut-out portion at a different location to allow contacting a second in-line sheet through a top sheet, said separation sheets are organized in said container in an alternating manner—a separation sheet of the first type is above a separation sheet of the second type or vice versa.

The present invention is of an add-on device to a Deli-slicer for separating food slices via interleaving, or separation sheets. Such interleaving/separation sheets are used to prevent the slices from joining again once they have been stacked and packaged.

In accordance with some embodiments of the present invention, there is thus provided an add-on device for a slicing machine for inserting a separation sheet in between food slices. The add-on device comprises:

(a) a container containing a sheet tray, (b) a pack of separation sheets positioned on said sheet tray, said pack of separation sheets comprises at least two types of separation sheets, a separation sheet of a first type and a separation sheet of a second type, each having a cut-out portion at a different location to allow contacting a second in-line sheet through a top sheet, said separation sheets are organized in said container in an alternating manner—a separation sheet of the first type is above a separation sheet of the second type or vice versa, (c) a mechanic/electro-mechanic mechanism for pushing said sheet tray upwards for loading and for preparing the pack of separation sheets for insertion in between said food slices, (d) a three-position lever, said three-position lever comprises a left wing, a right wing and a lever actuator, said lever actuator rotates clockwise and counterclockwise across its longitudinal axis in an alternating manner, and (e) an electronic system to monitor control and operate the operation of said add-on device.

Furthermore, in accordance with some embodiments of the present invention, the mechanic/electro-mechanic mechanism comprises an electromechanical actuator, a linear screw and a mechanical arm, said electromechanical actuator drives the linear screw in a straight line and the linear screw drives the mechanical arm which elevates the sheet tray for loading and for preparing the pack of separation sheets for insertion in between said food slices.

Furthermore, in accordance with some embodiments of the present invention, the mechanic/electro-mechanic mechanism comprises an elastic mechanism.

Furthermore, in accordance with some embodiments of the present invention, the three-position lever further comprises either a right pressure sensor or proximity sensor located on the right wing of said three-position lever and either a left pressure sensor or proximity sensor located on the left wing of the three-position lever for controlling the rotation angle of the actuator.

Furthermore, in accordance with some embodiments of the present invention, the lever actuator rotates clockwise till the right wing contacts a second in-line sheet through the cut-out portion of a top sheet to keep said second in-line sheet in place, as the top sheet is ready to be attached to a food slice, the lever actuator rotates counterclockwise till the left wing contacts the sheet underneath the top sheet to keep said sheet in place, said lever actuator rotates to and is kept at a middle position while said container is being filed with said separation sheets.

Furthermore, in accordance with some embodiments of the present invention, the add-on device is attached/connected to the slicing machine via connecting means selected from magnets, threaded connection, locking pins, and adhesive(s).

Furthermore, in accordance with some embodiments of the present invention, the add-on device further comprises at least one of:

an open chamber sensor indicating when the container is open, a paper tray level sensor indicating the position of the tray, and an empty tray sensor indicating when there are no separation sheets in said container.

Furthermore, in accordance with some embodiments of the present invention, the add-on device further comprises a lever encoder indicating the position of the three-position lever.

Furthermore, in accordance with some embodiments of the present invention, the electronic system of the add-on device comprises micro-controller unit or processing unit which carries an operation code of the add-on device, receives sensory inputs and outputs commands to said actuators.

Furthermore, in accordance with some embodiments of the present invention, the electronic system of the add-on device further comprises power supply circuit(s), a communication terminal to enable debugging and calibration procedures, and a display port for user interface and messages.

Furthermore, in accordance with some embodiments of the present invention, the add-on device further comprises a motion/acceleration sensor to measure slicer motion for synchronizing the rotation of the actuator.

Furthermore, in accordance with some embodiments of the present invention, the three-position lever is derived by a step motor enabling to control it's operation.

Furthermore, in accordance with some embodiments of the present invention, the add-on device further comprises a departure sensor for detecting a departure of said separation sheet attached to a food slice for initiating movement of a next on-line sheet.

DETAILED DESCRIPTION OF THE FIGURES

The present invention discloses an add-on device for a slicing machine for inserting a separation sheet in between food slices comprises:

(a) a container containing a sheet tray, (b) a pack of separation sheets positioned on said sheet tray, and (c) a mechanic/electro-mechanic mechanism for pushing said sheet tray upwards for loading and for preparing the pack of separation sheets for insertion in between said food slices, According to some embodiments, the add on further comprises:

a three-position lever, said three-position lever comprises a left wing, a right wing and a lever actuator, said lever actuator rotates clockwise and counterclockwise across its longitudinal axis in an alternating manner, and an electronic system to monitor, control, and operate the operation of said add-on device;

wherein said pack of separation sheets comprises at least two types of separation sheets, a separation sheet of a first type and a separation sheet of a second type, each having a cut-out portion at a different location to allow contacting a second in-line sheet through a top sheet, said separation sheets are organized in said container in an alternating manner—a separation sheet of the first type is above a separation sheet of the second type or vice versa.

Figure 1:
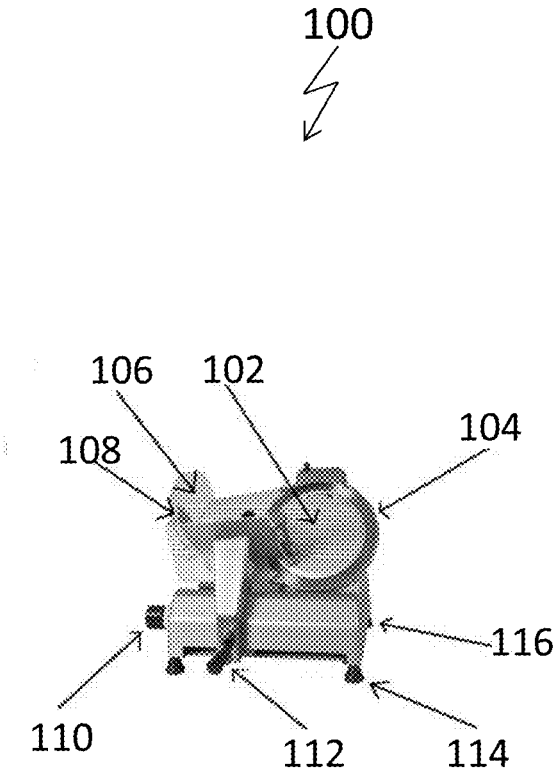
FIG. 1 (PRIOR ART) is a perspective view of a common slicer.

FIG. 1 (PRIOR ART) is a perspective view of a common slicer 100.

Slicing apparatus 100 comprises a baffle plate 102, blade 104, ramp 106, food tray 108, thickness adjustment knob 110, manual guide 112, non-slip feet 114, and power switch 116.

Figure 2A:
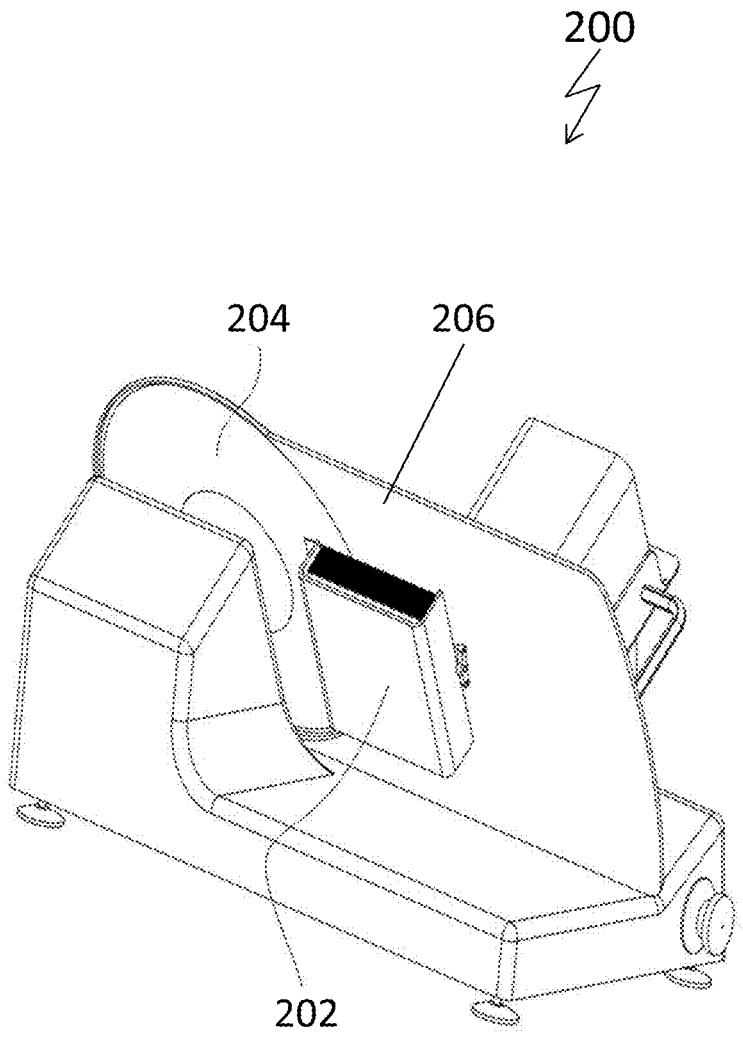
FIGS. 2A&B are perspective back side and front side views of a slicing apparatus with an add-on device in accordance with some embodiments of the present invention.
Figure 2B:
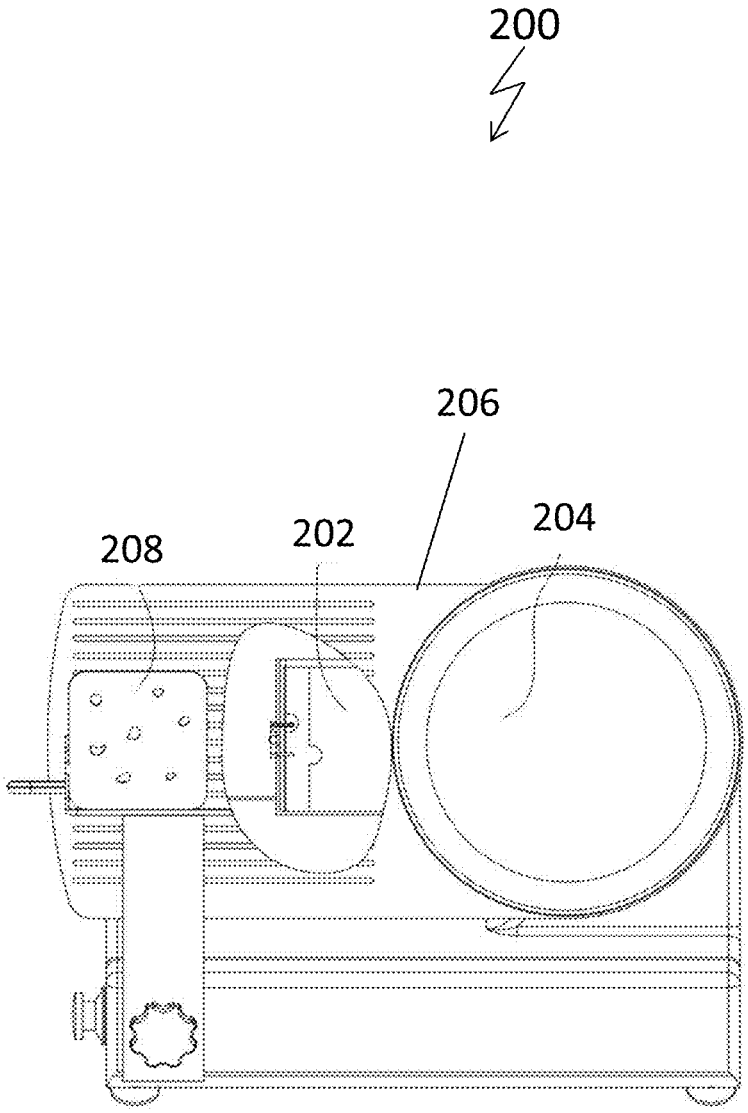

FIGS. 2A&B are perspective back-side and front-side views of a slicing apparatus 200 with an add-on device in accordance with some embodiments of the present invention. As seen in the figures, the slicing apparatus 200 of the present invention comprises an add-on device 202 integrated to the slicer 204 and provides an interleaving functionality to produce food slices with separation sheets in between the pieces.

As seen in the figures, the add-on device 202 may be installed at the back of the slicer ramp 206.

In accordance with some embodiments of the present invention, the add-on device 202 may be attached/connected to existing slicing apparatus 100 via magnets, threaded connection, locking pins, adhesive(s) and the like. For instance, to connect the add-on device 202 via threaded connection, the slicing apparatus 100 may be adjusted to enable threading connection(s). Alternatively, the outer surface of the add-on device 202 may include magnet piece(s), while the slicing apparatus 100 may be modified to include metal piece(s) such as iron and nickel or vice versa.

Figure 3A:
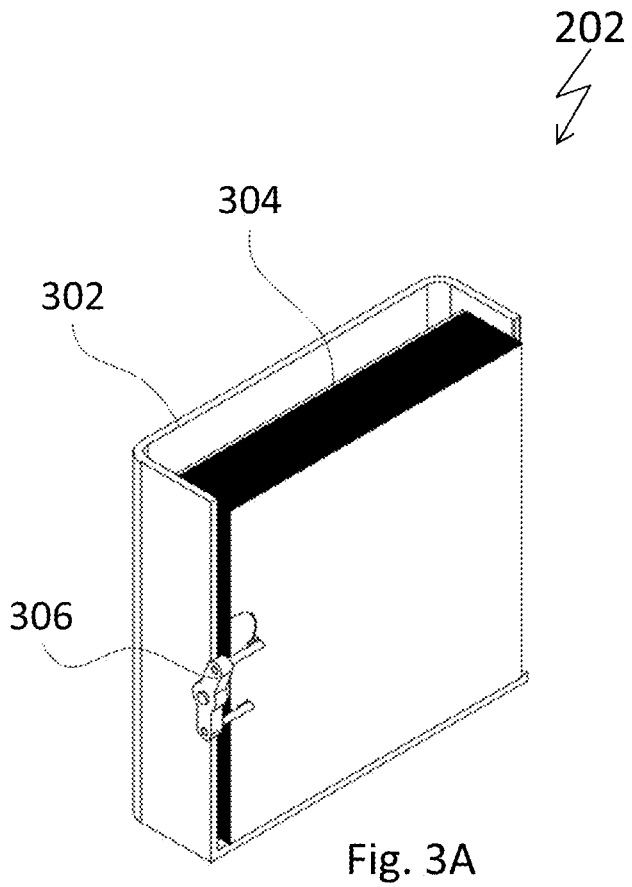
FIGS. 3A&B are perspective and side views of the add-on device in accordance with some embodiments of the present invention.
Figure 3B:
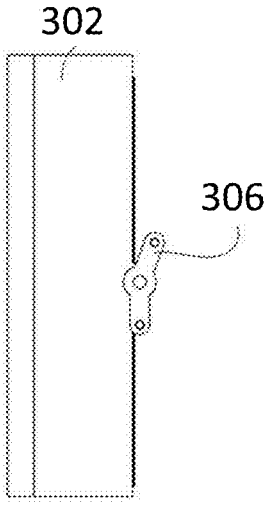

FIGS. 3A&B are perspective and side views of the add-on device 202 in accordance with some embodiments of the present invention.

In accordance with some embodiments of the present invention, the add-on device 202 comprises five main parts: a container 302, a pack of separation sheets (sheet magazine) 304, a three-position lever mechanism 306, an electro-mechanic or mechanic mechanism (seen in FIGS. 4A-D) for preloading the pack of separation sheets 304 to prepare them for the slice interleaving, and a programmable electronic control system (seen in FIG. 9) to actuate the operation of the add-on device 202.

The three-position lever mechanism 306 is located above the pack of separation sheets 304 and handovers the sheets towards the food. The three-position lever mechanism 306 conveys the next in-line sheet as the top interleaving sheet is ready to be attached to the sliced food at the departure position.

Figure 4A:
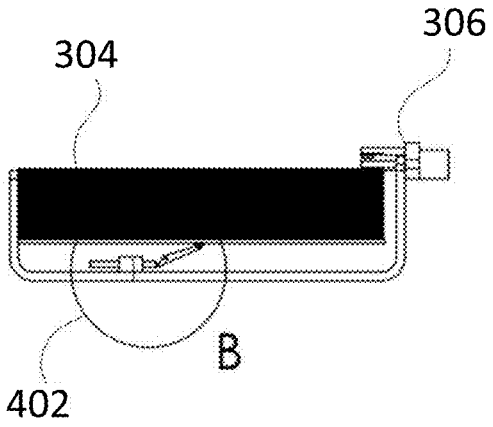
FIGS. 4A&B illustrate the sheet tray elevation mechanism which enables the top interleaving sheet to be located at the same departure position and with the same pressure.

FIGS. 4A&B illustrate a sheet tray elevation mechanism, e.g., an electro-mechanic mechanism 402, which enables the top interleaving sheet to be located at the same departure position and with the same pressure regardless of the number of sheets available in the sheet magazine.

FIG. 4A illustrates a portion of the add-on device 202 showing the pack of separation sheets 304, the three-position lever mechanism 306 and an electro-mechanic mechanism 402.

Figure 4B:
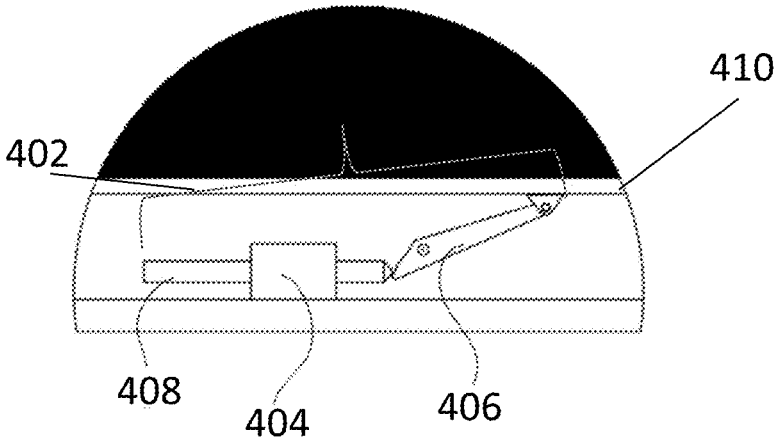
FIGS. 4C&D illustrate a sheet tray elevation mechanism that is a spring-based elastic mechanism.

FIG. 4B is a magnified view of the electro-mechanic mechanism 402 in accordance with some embodiments of the present invention. As seen in the figure, the electro-mechanic mechanism 402 comprises an electromechanical actuator 404, a mechanical arm 406, and a screw 408.

In accordance with some embodiments of the present invention, electromechanical actuator 404 drives the linear screw 408 in a straight line and the linear screw 408 drives mechanical arm 406 which elevates the sheet tray 410.

Figure 4C:
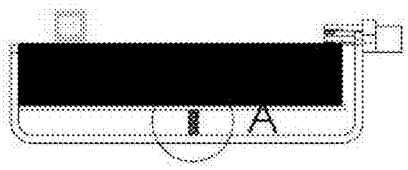
Figure 4D:
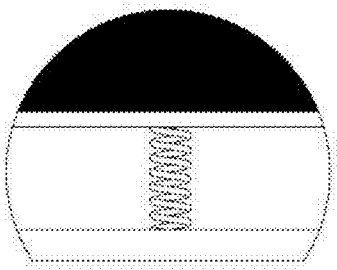

In accordance with some embodiments of the present invention, electromechanic mechanism 402 may be a spring-based elastic mechanism as seen in FIGS. 4C&D.

In accordance with some embodiments of the present invention, the pack of separation sheets 304 may contain various types of interleaving sheets where the difference between these types is the location of the cut-out portion. The cut-out portion may be different in shape as well.

Figure 5A:
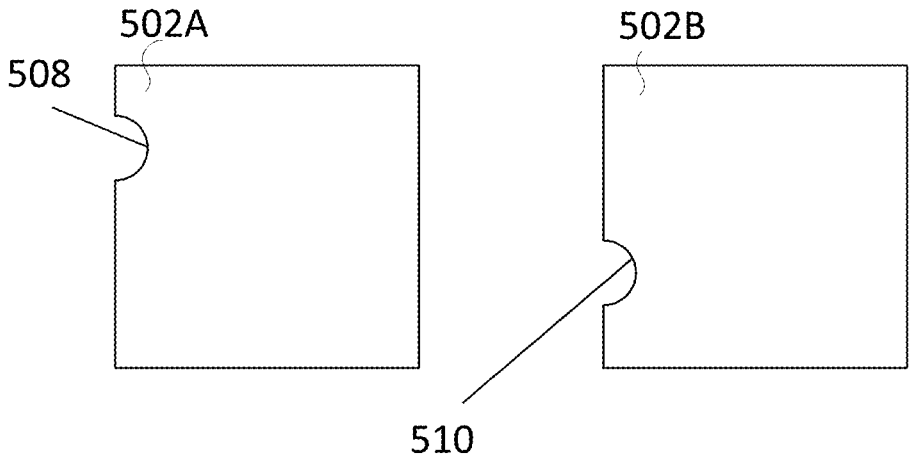
FIG. 5A illustrates two types of interleaving sheets in accordance with some embodiments of the present invention.

FIG. 5A illustrates two types of interleaving sheets, an interleaving sheet of a first type 502A and an interleaving sheet of a second type 502B in accordance with some embodiments of the present invention.

Figure 5B:
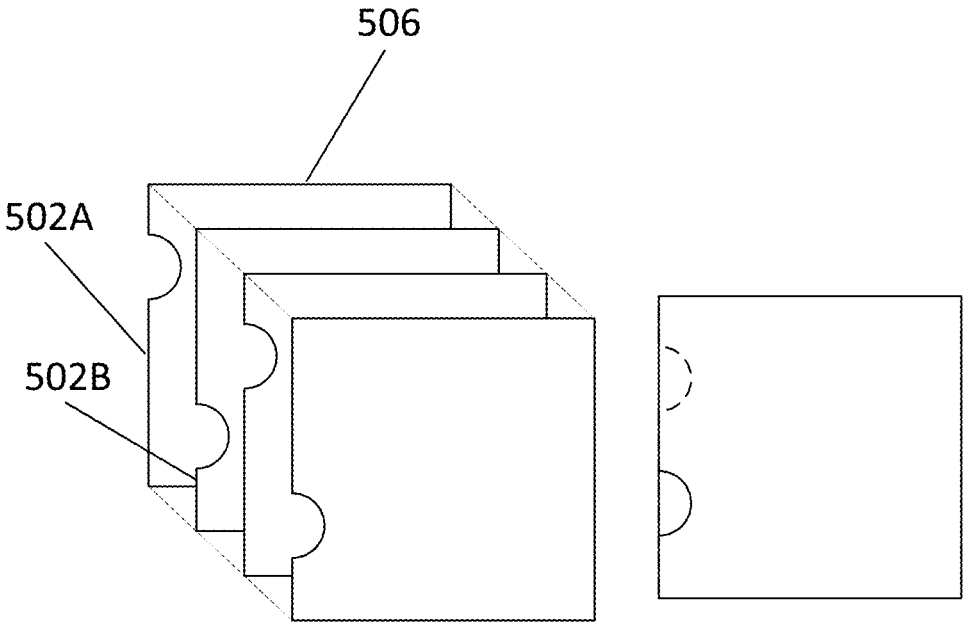
FIG. 5B illustrates a pack of separation sheets (sheet magazine) containing multiple interleaving sheets in accordance with some embodiments of the present invention.

FIG. 5B illustrates a pack of separation sheets (sheet magazine) 506 containing multiple interleaving sheets of the first type 502A and interleaving sheets of the second type 502B in accordance with some embodiments of the present invention.

As seen in FIG. 5A, the cut out portion 508 is in the top portion of sheet 502A while in sheet 502B the cut out portion 510 is in the bottom.

In accordance with some embodiments of the present invention, the sheets are organized in container 302 following the principle of two adjacent sheets are not from the same type, i.e., an interleaving sheet of the first type 502A is above an interleaving sheet of a second type 502B or vice versa (as seen in FIG. 5B).

Figure 6A:
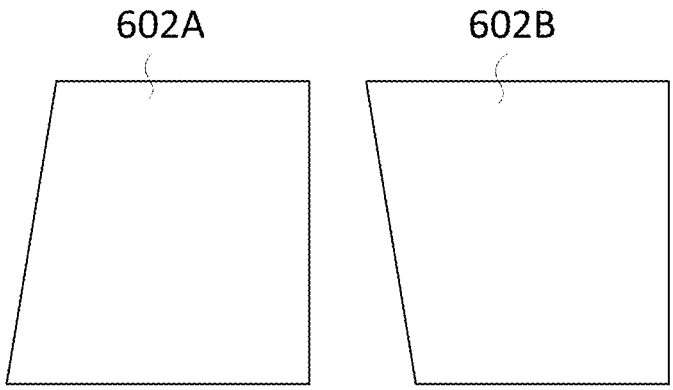
FIGS. 6A&B illustrate interleaving sheets with an alternative cutout shape in accordance with some embodiments of the present invention.

FIGS. 6A&B illustrate an alternative cutout shape that may be used herein.

FIG. 6A illustrates an interleaving sheet of a third type 602A and an interleaving sheet of a forth type 602B in accordance with some embodiments of the present invention.

Figure 6B:
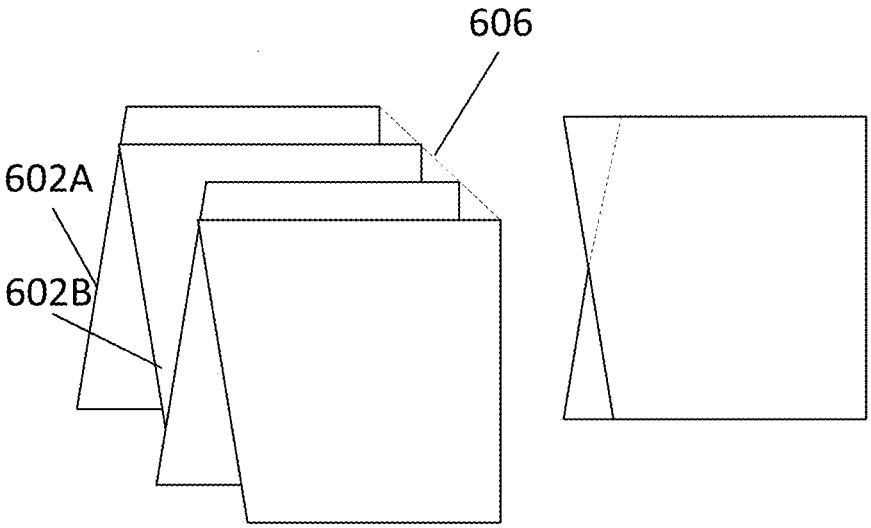

FIG. 6B illustrates a pack of separation sheets (sheet magazine) 606 containing multiple sheets of interleaving sheets of the third type 602A and an interleaving sheets of the forth type 602B in accordance with some embodiments of the present invention.

In accordance with some embodiments of the present invention, any asymmetrical cutout shape may be implemented, as long as it maintains the occupation mechanism described above.

Figure 7:
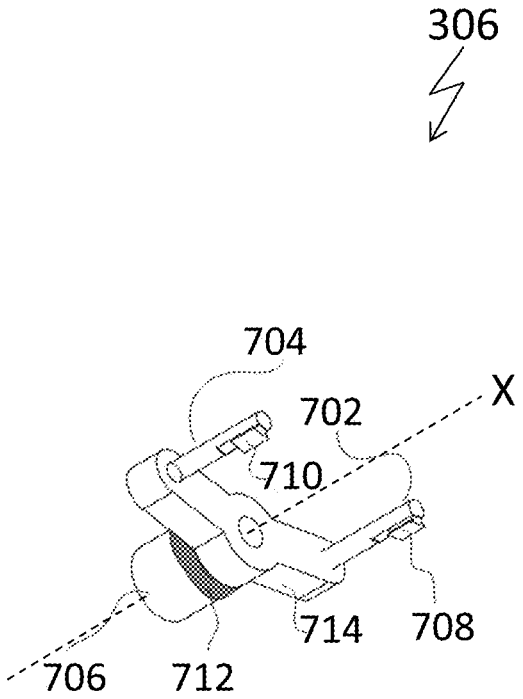
FIG. 7 is a perspective view of three-position lever mechanism in accordance with some embodiments of the present invention.
Figure 8B:
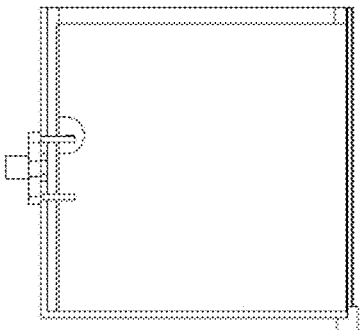
FIGS. 8A-D illustrate a departure sensor attached to the side surface of the container of the add-on device in accordance with some embodiments of the present invention.
Figure 8A:
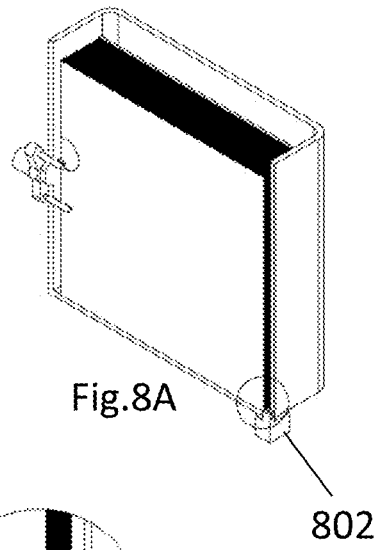
Figure 8C:
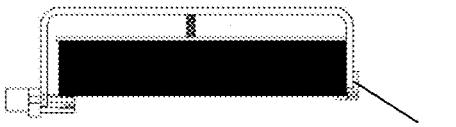
Figure 8D:
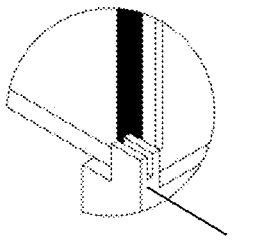

FIG. 7 is a perspective view of three-position lever mechanism 306 in accordance with some embodiments of the present invention.

As seen in the figure, three-position lever mechanism 306 comprises a left wing 702, a right wing 704, a lever actuator 706, a right pressure sensor 710, a left pressure sensor 708, a lever encoder 712, and a lever 714.

Organizing the interleaving sheets in the mentioned order enables three-position lever mechanism 306 to contact and press the second in line sheet through the cutout section of the top sheet. Once the top sheet attaches to the food slice and departures, the second in line sheet now becomes the top sheet, and the three-position lever 306 is set to the other position, where the next in line sheet is contacted and pressed through the cut out of the top sheet.

The third position of the three-position lever mechanism 306 is set to the middle, where neither of the lever arms pressed against the interleaving sheets. This position is used while filling up the sheet magazine.

Thus, in accordance with some embodiments of the present invention, the lever actuator 706 of three-position lever mechanism 306 rotates across its longitudinal axis X clockwise and counterclockwise interchangeably. The lever actuator 706 rotates clockwise till the right wing 704 contacts and presses the second in line sheet through the cut-out portion of the top sheet. Once the top sheet is ready to be attached to a food slice, the lever actuator 706 rotates counterclockwise till the left wing 702 contacts and presses the sheet underneath the top sheet.

It should be noted that the cutout sheets described above and the way these sheets are organized in container 302 enable such mechanism, i.e., enable the right wing 704 and the left wing 702 to contact and keep in place sheets that are underneath the top sheet.

In accordance with some embodiments of the present invention, a maximum rotation angle may be predefined for the three-position lever mechanism 306, i.e., a rotation angle corresponding to the case in which the tray 410 is empty of separation sheets, and either the right wing 704 or the left wing 702 touched the tray 410.

When the container 302 is empty of separation sheets, the lever actuator 706 stops rotating as soon as it reaches the max rotation angle, e.g., as soon as it reaches the inner surface of tray 410 and alerting means gets activated for warning of a malfunction.

In accordance with some embodiments of the present invention, actuator 706 rotates clockwise till right pressure sensor 710 senses the sheet underneath the top sheet or the inner surface of tray 410. Once the pressure sensor 710 senses the sheet, actuator 706 stops rotating, and the right wing 704 keeps the second in line sheet in place while the top sheets attaching the food and leaving the container 302. Then, as the top sheet leaves container 302, actuator 706 rotates to the other side, e.g., counterclockwise till the left pressure sensor 708 senses the sheet underneath the top sheet.

In accordance with some embodiments of the present invention, proximity sensors may replace the pressure sensors, the right pressure sensor 710 and the left pressure sensor 708, to sense the sheet underneath the top sheet while approaching and getting close to the sheet. In this case, the proximity sensors do not contact the second in-line sheet, but only get close to it, however, the presence of the right/left wing in proximity to the sheet blocks the sheet and keeps it in its place.

Alternatively, a mechanically operated actuator may replace actuator 706 and may not include sensors, i.e., the above-described pressure sensors, proximity sensors and the like. The mechanical actuator may rotate clockwise and counterclockwise interchangeably at a rotation rate compatible with the movement of the slicer 204. In accordance with some embodiments of the present invention, the add-on device 202 may include a departure sensor 802 for detecting the departure of an interleaving sheet attached to a food slice and thus for initiating the movement of the next on-line sheet.

Departure sensor 802 may be an opto-coupler component attached, for instance, to the side surface of container 302 as seen in FIGS. 8A-D which are perspective view, side view, cross-sectional view and a magnified view of the add-on device 202 with the departure sensor 802.

In accordance with some embodiments, the add-on device 202 may include a motion or acceleration sensor for sensing the circular acceleration or motion of the slicer 204 and a three-position lever mechanism 306 operable by a step motor for synchronizing the rotation of the actuator.

As the motion acceleration sensor senses a circular acceleration motion of the slicer 204, the three-position lever mechanism 306 gets activated to rotate clockwise and counterclockwise at a rotation rate compatible with the movement of the slicer 204. The rotation angle of the three-position lever mechanism 306 may be controlled by predefining the number of steps of the step motor, using as an open-loop actuator.

Figure 9:
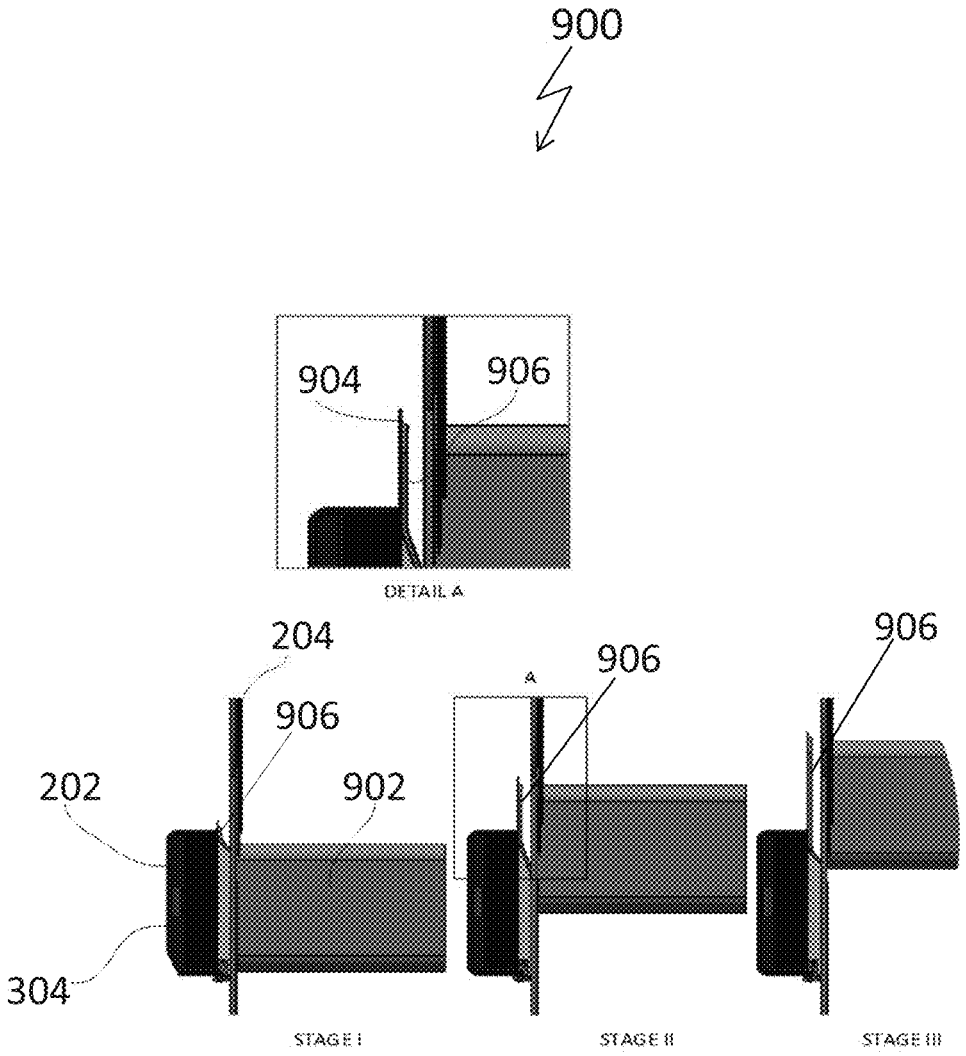
FIG. 9 illustrates a 3-stage interleaving process in accordance with some embodiments of the present invention.

FIG. 9 illustrates a 3-stage interleaving process 900 in accordance with some embodiments of the present invention. The figure illustrates a portion of a sliding machine with the add-on device 202 of the present invention. Thus, seen in the figure are the slicer 204, the food to be sliced 902, the food slice 906 and the add-on device 202—the pack of separation sheets 304 and interleaved sheet 904.

In STAGE I, the food slice 906 is attached to the interleaving sheet 904 in the departure position. After engaging the initial attachment, the food slice 906 coming out of the slicer pulls the interleaving sheet 904 during the slicing process as seen in STAGES II and III. When the food slices 906 are piling up on the deli slicer tray, they contain interleaving sheets 904 in between them.

In order to synchronize, control and monitor the add-on device 202, it should contain a a programmable electronic control system which is illustrated in FIG. 9.

The above-described operations are actuated by a programmable electronic system in accordance with some embodiments of the present invention.

Figure 10:
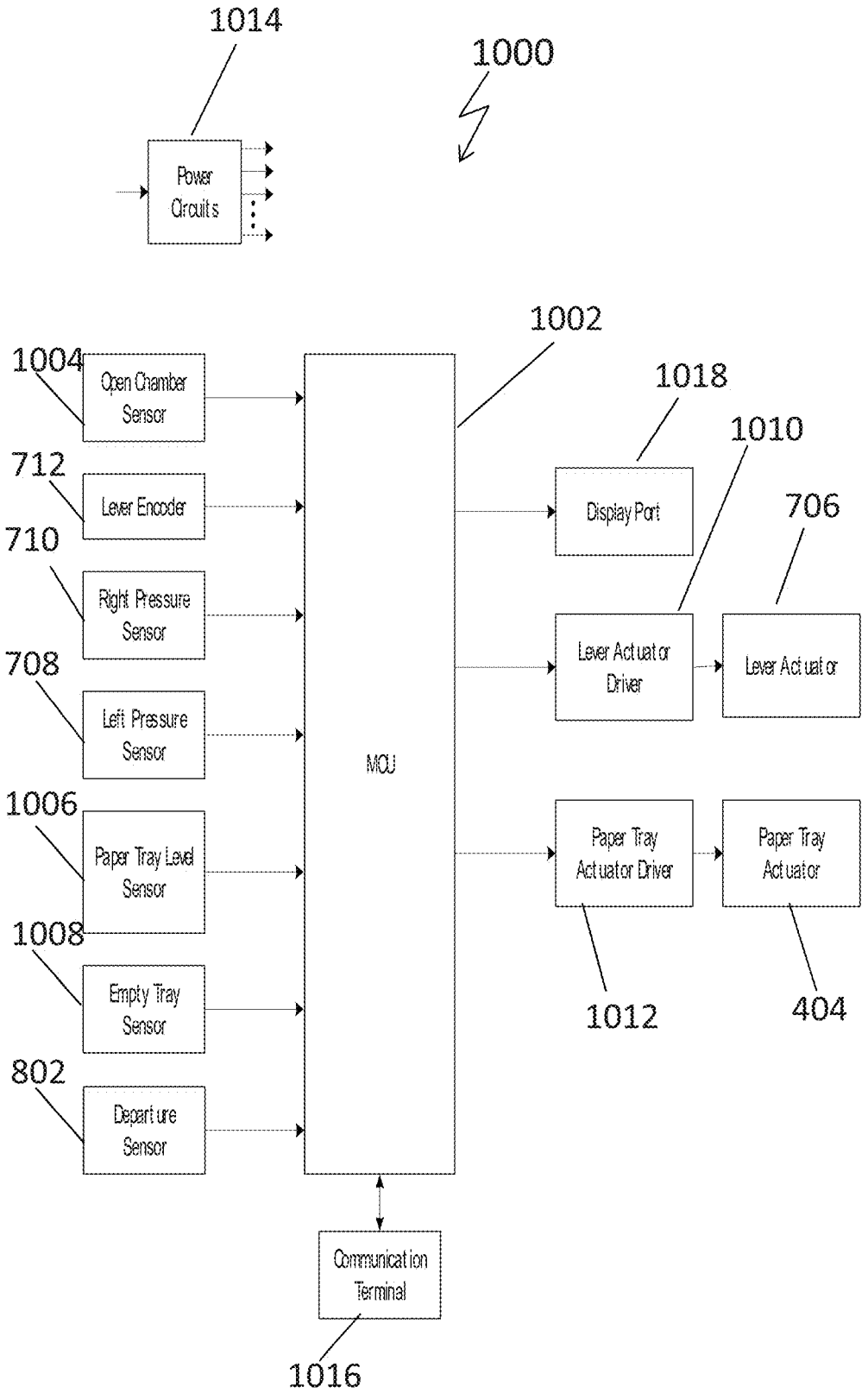
FIG. 10 is an electronic system block diagram of the add-on device in accordance with some embodiments of the present invention.

FIG. 10 is a block diagram of a programmable electronic control system 1000 which controls the operation of the add-on device 202 in accordance with some embodiments of the present invention.

The main component is a micro-controller unit (MCU) 1002 such as STM32L4. The MCU 1002 carries the operation code of the add-on device 202, receives the different sensors inputs and outputs commands to the system actuators.

As seen in the figure, the micro-controller unit (MCU) 1002 receives input and output commands from at least one of the following sensors: an open chamber sensor 1004, a right pressure sensor 710, a left pressure sensor 708, a paper tray level sensor 1006, an empty tray sensor 1008, and a departure sensor 1010.

The micro-controller unit (MCU) 1002 further controls lever encoder 712, multiple actuators including lever actuator 706 operable via a lever actuator driver 1010, and paper tray electromechanical actuator 404 operable via a paper tray actuator driver 1012.

In accordance with some embodiments of the present invention, the open chamber sensor 1004 indicates when the container 302 is open, the left pressure sensor 708 and the right pressure sensor 710 indicate the pressure level of the three-position lever mechanism 306 over the second in line sheet, the paper tray level sensor 1006 indicates the position of the tray 410, and empty tray sensor 1008 indicates when there are no interleaving sheets left in container 302.

In accordance with some embodiments of the present invention, the electronic system 1000 of the add-on device 202 further comprises a power supply circuits 1014, communication terminal 1016 to enable the communication to the "outer world", mainly for debugging and calibration procedures, and a display port 1018 for user interface and messages (e.g. "empty tray", "error", etc.).

It should be noted that the implementation of the programmable electronic control system 1000 may be achieved using different system components and the description herein is for reference only.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. An add-on device for a slicing machine for inserting a separation sheet in between food slices comprising:

(a) a container containing a sheet tray, (b) a pack of separation sheets positioned on said sheet tray, and (c) a mechanic/electro-mechanic mechanism for pushing said sheet tray upwards for loading and for preparing the pack of separation sheets for insertion in between said food slices, and (d) a three-position lever, said three-position lever comprising a left wing, a right wing and a lever actuator, said lever actuator rotating clockwise and counterclockwise across its longitudinal axis in an alternating manner, wherein said pack of separation sheets comprises at least two types of separation sheets, a separation sheet of a first type and a separation sheet of a second type, each having a cut-out portion at a different location to allow contacting a second in-line sheet through a top sheet, said separation sheets being organized in said container in an alternating manner wherein a separation sheet of the first type is above a separation sheet of the second type or vice versa.

2. The add-on device of claim 1, further comprising a system to monitor, control, and operate the operation of said add-on device.

3. The add-on device of claim 1, wherein said mechanic/electro-mechanic mechanism comprises an electromechanical actuator, a linear screw and a mechanical arm, said electromechanical actuator drives the linear screw in a straight line and the linear screw drives the mechanical arm which elevates the sheet tray for loading and for preparing the pack of separation sheets for insertion in between said food slices.

4. The add-on device of claim 1, wherein said mechanic/electro-mechanic mechanism comprises a spring.

5. The add-on device of claim 2, wherein the three-position lever further comprises either a right pressure sensor or proximity sensor located on the right wing of said three-position lever and either a left pressure sensor or proximity sensor located on the left wing of the three-position lever for controlling the rotation angle of the actuator.

6. The add-on device of claim 2, wherein said lever actuator rotates clockwise till the right wing contacts a second in-line sheet through the cut-out portion of a top sheet to keep said second in-line sheet in place, as the top sheet is ready to be attached to a food slice, the lever actuator rotates counterclockwise till the left wing contacts the sheet underneath the top sheet to keep said sheet in place, said lever actuator rotates to and is kept at a middle position while said container is being filed with said separation sheets.

7. The add-on device of claim 6, wherein a preferred connecting means allows varying the distance between the add-on device and the slicing apparatus to allow slicing food at various thicknesses.

8. The add-on device of claim 1 further comprises at least one of:

an open chamber sensor indicating when the container is open, a paper tray level sensor indicating the position of the tray, and an empty tray sensor indicating when there are no separation sheets in said container.

9. The add-on device of claim 2, further comprising a lever encoder indicating the position of the three-position lever.

10. The add-on device of claim 2, wherein the electronic system of the add-on device comprises micro-controller unit or processing unit which carries an operation code of the add-on device, receives sensory inputs and outputs commands to said actuators.

11. The add-on device of claim 2 wherein the electronic system of the add-on device further comprises power supply circuit(s), a communication terminal to enable debugging and calibration procedures, and a display port for user interface and messages.

12. The add-on device of claim 1, wherein the add-on device further comprises a departure sensor for detecting a departure of said separation sheet attached to a food slice for initiating movement of a next on-line sheet.

13. An add-on device for a slicing machine for inserting a separation sheet in between food slices comprising:

(a) a container containing a sheet tray, (b) a pack of separation sheets positioned on said sheet tray, (c) a mechanic/electro-mechanic mechanism for pushing said sheet tray upwards for loading and for preparing the pack of separation sheets for insertion in between said food slices, (d) a three-position lever, said three-position lever comprising a left wing, a right wing and a lever actuator, said lever actuator rotating clockwise and counterclockwise across its longitudinal axis in an alternating manner, and (e) an electronic system to monitor, control, and operate the operation of said add-on device, wherein said pack of separation sheets comprises at least two types of separation sheets, a separation sheet of a first type and a separation sheet of a second type, each having a cut-out portion at a different location to allow contacting a second in-line sheet through a top sheet, said separation sheets being organized in said container in an alternating manner wherein a separation sheet of the first type is above a separation sheet of the second type or vice versa.

* * * * *